United States Patent [19]

Hirato et al.

[11] 4,270,373

[45] Jun. 2, 1981

[54] APPARATUS AND PROCESS FOR THE FLUID LUBRICATION DRAWING OF COMPOSITE METAL WIRES

[76] Inventors: Motoshiro Hirato, Sukegawa-cho 4-18-26; Hazime Kawagoe, Narusawa-cho 4-3-3; Kazuo Abe, Takasuzu-cho 1-21-12, all of Hitachi-shi, Ibaragi-ken; Tsuyoshi Sato, Oaza Kamitetsuna 1113, Takahagi-shi, Ibaragi-ken; Yasuhiko Miyake, Nishinarusawa-cho 4-29-14; Masahiro Nagai, Higashi-cho 4-5-6, both of Hitachi-shi, Ibaragi-ken; Katsuhisa Furuichi, Korokudai Takuno 215, Matsudo-shi, Chiba-ken; Kiyoshi Shimojima, Ogitsu-cho 3679, Hitachi-shi, Ibaragi-ken, all of Japan

[21] Appl. No.: 43,817

[22] Filed: May 30, 1979

[51] Int. Cl.[3] ..... B21C 9/00; B21C 3/00

[52] U.S. Cl. ..... 72/41; 72/47; 72/467

[58] Field of Search ..... 72/41, 43, 45, 47, 274, 72/467; 76/107 A

[56] References Cited

U.S. PATENT DOCUMENTS

| | | | |
|---|---|---|---|
| 1,015,913 | 1/1912 | Stratton et al. | 76/107 A |
| 1,896,674 | 2/1933 | Longwell | 72/41 X |
| 2,149,330 | 3/1939 | Blount | 76/107 A |
| 2,349,652 | 5/1944 | Fenner | 72/467 |
| 3,080,962 | 3/1963 | Fleischmann et al. | 72/41 |
| 3,413,832 | 12/1968 | Lang et al. | 72/42 |
| 3,526,115 | 9/1970 | Armstrong et al. | 72/45 |
| 3,740,990 | 6/1973 | Prajsnar et al. | 72/467 X |
| 3,763,680 | 10/1973 | Godfrey et al. | 72/467 X |

*Primary Examiner*—Ervin M. Combs

*Attorney, Agent, or Firm*—Burns, Doane, Swecker & Mathis

[57] ABSTRACT

A rod in the form of a composite metal wire having a harder metal core surrounded by a softer metal cladding is introduced together with lubricant into a die comprising an approach which includes a first frustoconical opening defining a vertical angle between 0° and 5° (exclusive of 0°) and a second frustoconical opening defining a vertical angle between 6° and 20°. The lubricant is pressurized in the first frustoconical opening of the die approach while the rod is drawn under fluid lubrication.

18 Claims, 13 Drawing Figures

(drawing speed: 25.2 m/min
lubricant : metallic soap
die : water-cooling)

APPARATUS AND PROCESS FOR THE FLUID LUBRICATION DRAWING OF COMPOSITE METAL WIRES

BACKGROUND OF THE INVENTION

This invention relates to a process for the fluid lubrication drawing of composite metal wires and an apparatus used therefor.

Composite metal wires having a softer metal cladding around a harder metal core are well known in the art. Aluminum clad steel wires, for example, are widely used as overhead transmission and distribution lines or the like.

Such aluminum clad steel wires are of varying sizes, ranging from thin wires of about 2.0 mm in diameter to thicker wires. Thin wires have an aluminum cladding whose thickness decreases in proportion to the diameter. Thin wires are difficult to fabricate because thin wires, when fabricated by extrusion, for example, by extruding aluminum around a steel core, often suffer from such problems as reduced adhesion, nonuniform section, and aluminum cladding peeling. Sometimes the physical properties such as tensile strength of extruded wires do not fall in the appropriate range. In order to obviate these problems, attempts were made to draw aluminum clad wires for the reduction of their diameter.

The purpose of drawing is to produce a thin aluminum clad wire from the corresponding wire of a larger diameter. At the same time, improvements in yield and wire strength are achieved. Further, high speed drawing insures a satisfactory production speed.

However, aluminum clad wires could not be drawn by means of dies generally used for drawing single metal wires such as aluminum, copper or steel wires because a steel core having a substantial deformation resistance is coated with aluminum having a low deformation resistance.

Using a prior art die as shown in FIG. 1*c*, the inventors made an experiment of drawing an aluminum clad wire. It was found that aluminum accumulated at the entrance of the die and the wire was broken after it was drawn several ten meters. During this drawing, the steel core was not deformed at all and only the aluminum cladding was deformed. Excessive aluminum accumulated within the die, which acted like a wedge, causing wire breaking.

With this information the inventors speculated as follows. In drawing composite metal wires, drawing will be possible only when both a higher deformation resistant steel core and a lower deformation resistant aluminum cladding are deformed at the same reduction of area. In order to subject the steel wire to deformation, a forebody having a slightly larger diameter than a rod to be drawn and having a certain length is provided at the inlet of the die to restrain the aluminum accumulating at the die inlet, thereby increasing the pressure of aluminum between the inner wall of the die and the steel core. This increased pressure of aluminum causes the steel core to be deformed, enabling drawing. The inventors made various experiments to find that this speculation is correct. Based on these experiments, the inventors have completed the optimum process and apparatus for drawing composite metal wires.

Fleischmann et al, U.S. Pat. No. 3,080,962 (assigned to Copperweld Steel Company) discloses die drawing of aluminum clad steel wires. A set of three dies each having an approach angle of about 12°–16° is used to effect three-stage drawing of an aluminum clad steel wire while applying powder lubricant. This dry die drawing has some drawbacks. The die drawing devices with three dies built in are larger than usual devices. Powder lubricants such as metallic soap must be applied to draw wires. It is necessary from the point of view of product value and corrosion of wires to remove scales on the wire surface after drawing. In this respect, drawing processes using liquid lubricant are advantageous.

SUMMARY OF THE INVENTION

The primary object of this invention is to determine the optimum die structure which allows composite metal wires to be drawn without the above-described problems.

Another object of this invention is to design a compact drawing die apparatus.

A further object of this invention is to provide a commercially useful drawing process in which liquid lubricant may be used.

This invention provides an improved process for the fluid lubrication drawing of composite metal wires. A die is used which has an approach including a first frustoconical opening having an inclination angle between 0° and 5° (exclusive of 0°) in terms of an overall or vertical angle and a succeeding second frustoconical opening having an inclination angle between 6° and 20° in terms of an overall or vertical angle. A rod in the form of a composite metal wire comprising a harder metal core and a softer metal cladding surrounding the core is introduced into the die together with a lubricant. The rod is drawn under fluid lubrication while the lubricant is pressurized in the first frustoconical opening of the die approach.

Examples of the composite metal wires available in this invention include aluminum clad steel wires, copper clad steel wires, lead clad steel wires, aluminum clad copper wires and lead clad aluminum wires, but not limited thereto.

The lubricants used in this invention may be either powder lubricants such as powder metallic soap or liquid lubricants such as polybutene oil, cylinder oil, dynamo oil, castor oil, rape oil and the like.

These and other objects of this invention will become apparent to those skilled in the art from the following detailed description and attached drawing upon which only the preferred embodiments of this invention are illustrated.

DESCRIPTION OF THE PREFERRED EMBODIMENTS

Figure 1A:
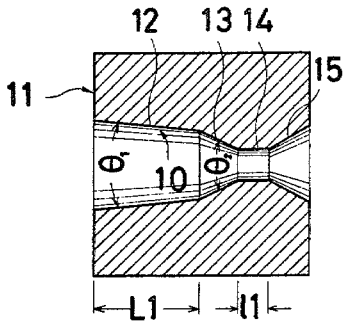
FIGS. 1*a* and 1*b* are cross sections of different embodiments of the drawing die according to this invention, respectively.

Referring to FIG. 1*a*, a die used in this invention is generally designated by numeral 11. The die 11 comprises an approach 10 which includes a first inclined side or frustoconical opening 12 having an inclination or inclined angle $\theta_1$ between 0° and 5° (exclusive of 0°) and a second inclined side or frustoconical opening 13 succeeding the first opening and having an inclination angle $\theta_2$ between 6° and 20°. The inclination or inclined angles $\theta_1$ and $\theta_2$ represent the vertical angles of imaginary cones of the frustoconical openings 12 and 13, respectively. The die 11 further comprises a bearing 14 and a back relief 15.

Figure 1B:
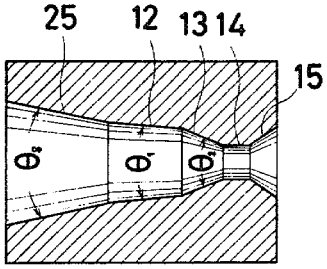
Figure 1C:
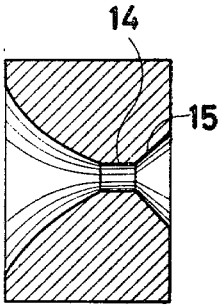
PRIOR ART FIG. 1c
FIG. 1*c* is a cross section of a prior art drawing die.

FIG. 1*c* shows a cross section of a prior art die used for metal drawing, which includes a tapered approach, a bearing 14 and a back relief 15.

In the initial stage of development, the inventors found according to expectation that dies having the configuration shown in FIG. 1*a* are effective to draw aluminum clad steel wires.

Figure 2A:
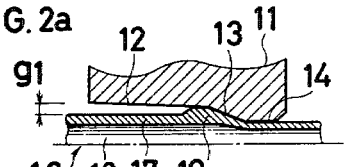
FIGS. 2*a* and 2*b* are cross sections of a part of the die and different rods being drawn illustrating the deformation of the rods, respectively.

To determine the structure of the die 11, the inventors made the following investigations. A rod in the form of an aluminum clad steel wire 16 was drawn by means of the die 11. Drawing was interrupted in the process. The rod was pulled back from the die to examine the surface state of the rod deformed. The deformation state of the rod 16 in the die 11 is shown in FIG. 2*a*. The rod 16 in the form of an aluminum clad steel wire is illustrated as having an aluminum cladding 17 and a steel core 18. A difference in reduction of area between the aluminum cladding 17 and the steel core 18 causes an excessive amount of aluminum to be left at 19 in the die opening. The first inclined side 12 restrains this excess aluminum portion 19 from escaping toward the die inlet before the aluminum cladding 17 moves into contact with the second inclined side 13. As a result of this restraint, the excessive aluminum portion 19 is highly pressurized between the die wall and the steel core 18. This highly pressurized aluminum 19 acts as a substitute die for drawing the steel core 18.

Figure 2B:
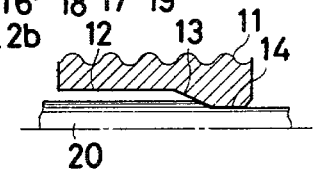

FIG. 2*b* shows the deformation state of another rod 20 in the same die 11. This rod 20 is a single metal wire such as aluminum, steel and copper wires. In this case, the rod 20 is reduced by the second inclined side 13 of the die and drawn to a predetermined diameter through the bearing 14.

Next, consideration was made on the influence on drawing of a gap $g_1$ between the first inclined side 12 of the approach 10 and the rod 16 to be drawn which is an important factor of die drawing according to this invention. The approach gap $g_1$ is herein defined as a difference between the maximum diameter of the first frustoconical side 12 and the diameter of the rod 16 to be drawn and believed to significantly affect aluminum pressure increase and lubrication. Different types of aluminum clad steel wire samples were drawn at a given drawing speed to determine the necessary drawing force. The size and properties of the samples used are shown in Table 1.

TABLE 1

| Wire Samples | | | | | |
|---|---|---|---|---|---|
| Sample No. | Diameter (mm) | Aluminum thickness (mm) | Tensile strength (kg/mm$^2$) | Butt elongation (%) | Twist (times) |
| 1 | 4.26 | 0.3 | 90.0 | 2.4 | 13 |
| 2 | 4.26 | 0.3 | 139.2 | 4.8 | 31 |
| 3 | 4.32 | 0.3 | 110.8 | 3.6 | 32 |
| 4 | 4.31 | 0.5 | 99.0 | 4.4 | 22 |
| 5 | 4.70 | 0.5 | 96.7 | 4.4 | 37 |

Figure 3:
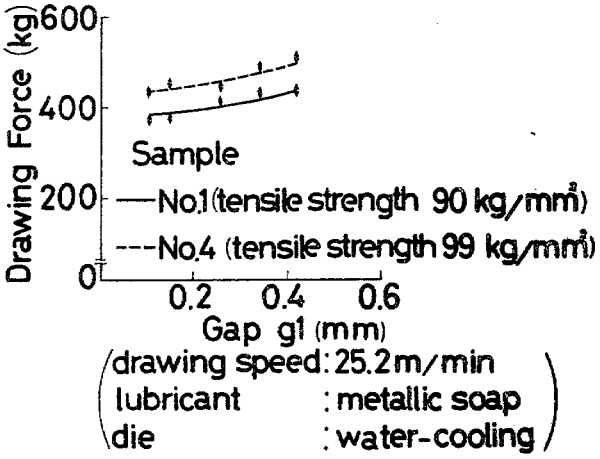
FIG. 3 is a diagram showing the relationship of a guide gap to a drawing force.

FIG. 3 illustrates the influence of the approach gap $g_1$ on the drawing force. It is shown that the drawing force increases with the increasing approach gap. The reason will be considered as follows. The rod 16 in the drawing die 11 is in the deformed condition as shown in FIG. 2*a*. With the approach gap increased, the reduction of area increases, requiring a larger drawing force. With narrower approach gaps, the lubrication between the die opening wall and the rod 16 is improved so that a smaller drawing force will suffice. Differently stated, increased approach gaps allow the lubricant to readily flow back and do not cause a significant pressure rise of the aluminum accumulated at 19 in the approach gap so that only part of the lubricant contributes to lubrication. On the other hand, reduced approach gaps do not allow or allow only part of the lubricant to flow back, causing a significant pressure rise of the accumulated aluminum 19 in the approach gap and improving the lubrication between the die opening wall and the rod.

Figure 4:
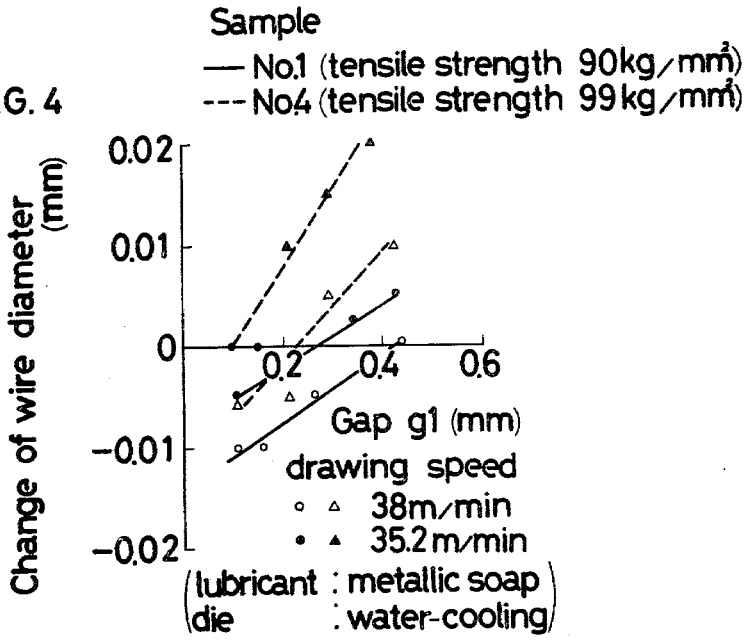
FIG. 4 is a diagram showing the relationship of the guide gap to the diameter of a wire.

FIG. 4 illustrates the influence of the approach gap on the diameter of a wire drawn. FIG. 4 shows that the diameter of drawn wires increases to above the desired level as the approach gap $g_1$ increases. It is also known that the change of wire diameter varies with the tensile strength of the rod to be drawn. This means that the optimum approach gap $g_1$ may be selected to be small so as to carry out drawing with a reduced drawing force if the requirement on the accuracy of wire diameter is not so strict. However, if a strict dimensional accuracy is required, the optimum approach gap should be determined in consideration of the strength of a rod to be drawn. In general, approach gaps of 0.1–0.5 mm assure satisfactory drawing. It was found that the approach gap does not affect the mechanical properties of wires drawn.

It was also found that the drawing force increases with the axial length of the bearing 14 although the variation is not illustrated. With the increased bearing length $l_1$ (see FIG. 1*a*), the contact area between the rod and the die opening wall increases, resulting in a larger frictional force.

The above facts show that the drawing force decreases as the bearing length $l_1$ and approach gap $g_1$ decrease. The diameter of drawn wires increases to above the desired level as the bearing length $l_1$ decreases or as the approach gap $g_1$ and drawing speed increase. It was also found that the drawing force can be reduced by cooling the die during drawing. This leads to power consumption saving.

Another experiment was carried out to examine how drawing depends on the inclination angles $\theta_1$ and $\theta_2$ of the first and second frustoconical openings 12 and 13 of the approach. Aluminum clad steel wires were drawn using dies having different inclination angles $\theta_1$ and $\theta_2$. The results are shown in Table 2. The dies used had an axial length $L_1$ of the first opening 12 of 20 mm and an axial length $l_1$ of the bearing 14 of 2 mm (see FIG. 1*a*). The drawing speed is 100 m/min. and the reduction of area is 10–30%.

TABLE 2

| | Drawing Results at Varying Inclination Angles | | | | | | | | | | |
|---|---|---|---|---|---|---|---|---|---|---|---|
| $\theta_1$ | $\theta_2$ 5° | 6° | 7° | 8° | 10° | 12° | 15° | 18° | 20° | 22° | 25° |
| minimal angle* | X | X | X | G | G | G | G | G | F | X | X |
| 1° | X | F | G | G | G | E | E | G | G | F | X |
| 2° | X | G | E | E | E | E | E | E | G | F | X |
| 3° | X | F | G | E | E | E | E | E | G | F | X |
| 4° | X | X | F | G | G | G | G | G | F | X | X |
| 5° | X | X | X | F | F | F | G | F | F | X | X |
| 6° | X | X | X | X | X | X | F | X | X | X | X |
| 8° | X | X | X | X | X | X | X | X | X | X | X |

E: excellent drawn wire
G: good drawn wire
F: fair drawn wire
X: rejected
*: angle providing a difference of diameter between the first opening inlet and outlet of 0.4 mm at $L_1$ = 20 mm (approximately 30 minutes)

In those samples evaluated as F or X, only the aluminum cladding was deformed and excessive aluminum accumulated in the die approach. The accumulated aluminum acts like a wedge causing wire breaking. Consequently, the steel core was scarecely deformed.

As seen from Table 2, the inclination angles $\theta_1$ and $\theta_2$ ensuring allowable drawn wires fall in certain ranges. Specifically, the first inclination angle $\theta_1$ falls within the range of 0° to 5° (exclusive of 0°), preferably 2° to 3° and the second inclination angle $\theta_2$ falls within the range of 6°–20°, preferably 8°–14°. Smooth fluid lubrication drawing is ensured within these ranges. Out of these ranges, effective fluid lubrication drawing is not always ensured due to additional barrier lubrication. Further, the first frustoconical opening 12 may preferably have an axial length $L_1$ of at least 10 mm, especially 15–50 mm for the best lubrication drawing.

Figure 5:
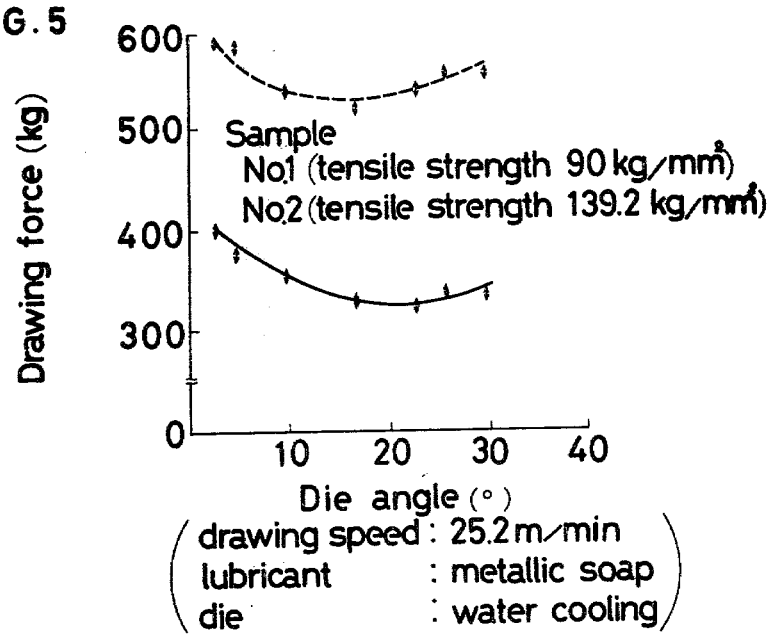
FIG. 5 is a diagram showing the relationship of a die angle to the drawing force.

Aluminum clad wires were drawn using dies having a fixed first inclination angle $\theta_1$ and a varying second inclination angle $\theta_2$. FIG. 5 illustrates how the drawing depends on the second inclination angle or die angle $\theta_2$. It is shown that the drawing force varies with the angle $\theta_2$ and decreases to minimum at specified angles which depend on the tensile stength of samples. The optimum inlination angle $\theta_2$ varies from approximately 15° in drawing of relatively high deformation resistance rods to approximately 23° in drawing of relatively low deformation resistance rods.

Figure 6:
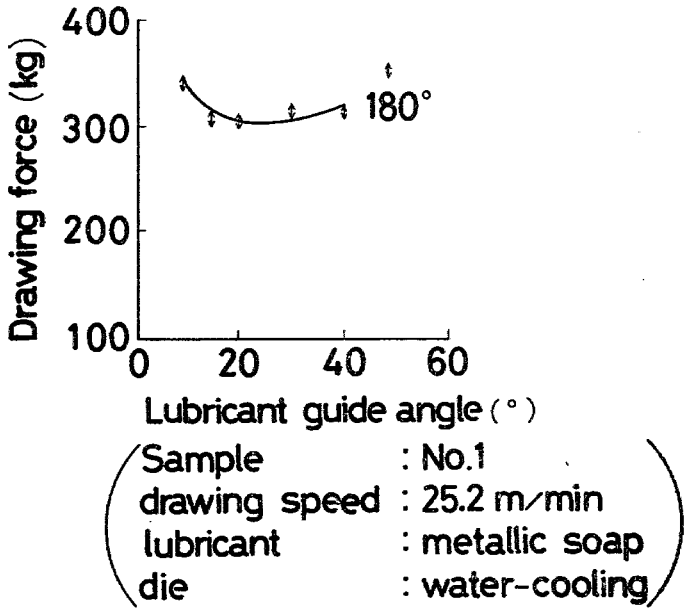
FIG. 6 is a diagram showing the relationship of a lubricant guide angle to the drawing force.

To allow the lubricant to advance smoothly to the die approach 10, the die 11 may preferably be provided with a lubricant guide 25 as shown in FIG. 1*b*. The opening of the guide 25 is also frustoconical and having a guide angle $\theta_3$ calculated in terms of an overall or vertical angle. How the drawing force depends on the guide angle $\theta_3$ is illustrated in FIG. 6. The drawing force is minimum when the guide angle $\theta_3$ is approximately 20°. The drawing force increases with smaller guide angles $\theta_3$ because the lubricant entrained by the rod being drawn is forced into the gap between the die and the rod under considerable pressure. The pressure of the lubricant in the guide 25 is eventually raised, causing the friction between the rod and the lubricant to increase. This increased frictional force offsets or exceeds a reduction of the drawing force resulting from improved lubricity along the die approach 10 and the bearing 14 due to increased pressure of the lubricant. On the other hand, as the guide angle $\theta_3$ increases from 20° to higher degrees, the pressure of the lubricant in the guide is increased to a less extent, causing the friction between the rod and the lubricant to decrease. However, the pressure of the lubricant in the approach 10 is also decreased to lower the lubricity, resulting in increased drawing forces.

Figure 7A:
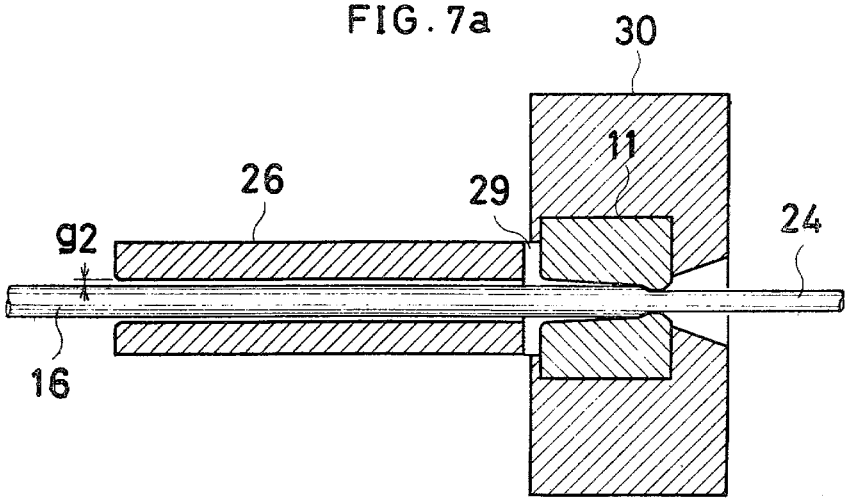
FIG. 7*a* is a cross section of a die and guide bushing assembly through which a rod is being drawn.
Figure 7B:
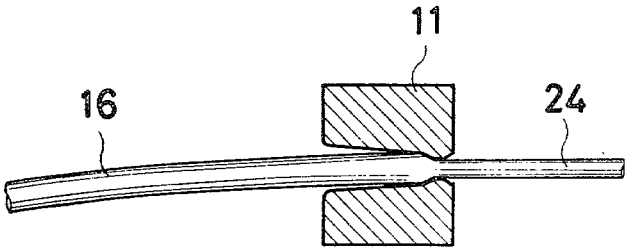
FIG. 7*b* is a cross section of a die without a guide bushing.

FIG. 7*a* shows a die assembly including the die 11 and a hollow cylindrical guide bushing 26 preceding the die. The opening of the guide bushing communicates and is in alignment with that of the die. Without the guide bushing 26, the rod 16 is sometimes drawn more on one side than the other side as shown by an arcuate rod in FIG. 7*b*. Nonuniform section sometimes causes the aluminum cladding to be peeled or the wire to be broken. The guide bushing 26 is provided for the purpose of assisting the rod 16 in entering the die 11 straightly. This arrangement is particularly suited for drawing using liquid lubricant because a stable high pressure is developed to the llubricant in the guide bushing 26. The preferred inner diameter of the guide bushing 26 is equal or approximates to the maximum diameter of the die approach 10 adjoining the rear end of the guide bushing. The guide bushing 26 may preferably have a length of at least 30 mm. Since a too long guide bushing extends the entire die assembly, the upper limit of the bushing length is 100 mm.

In the embodiment shown in FIG. 7*a*, the die is designed so that the first frustoconical opening 12 of the die approach 10 has an inclination angle $\theta_1$ of 2° and the second frustoconical opening 13 has an inclination angle $\theta_2$ of 14°. In this embodiment, the lubricant is subjected to a high pressure in the first opening 12 and the rod 16 is deformed or worked into a wire 24 under fluid lubrication through the second opening 13. The preferred working ratio is 10–15%.

Figure 8:
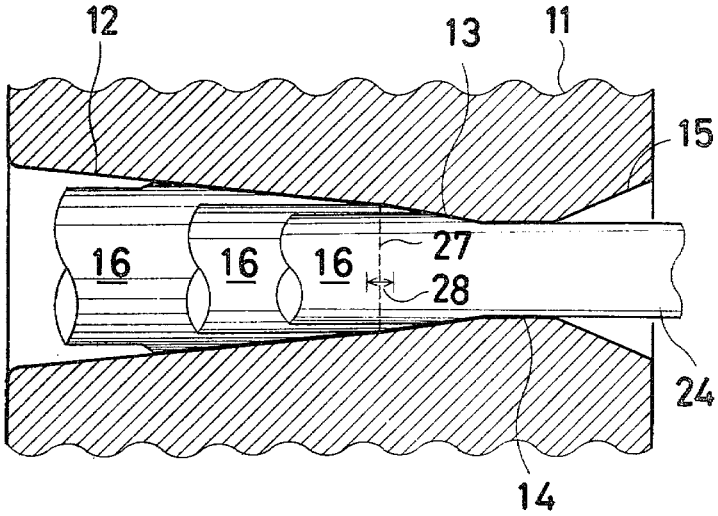
FIG. 8 is an enlarged view of the die opening and rods of different diameters being drawn therethrough.

FIG. 8 illustrates three rods of different diameters which are drawn through the die according to this invention. With respect to the diameter of a rod 16 to be drawn, it is preferable to select a diameter which is equal to the diameter of the die opening at the junction 27 or an equivalent point between the first and second frustoconical openings 12 and 13 with a tolerance of plus or minus 5%. The range covering tolerances of plus or minus 5% of the optimum diameter is shown at 28. The rod 16 to be drawn should be of a diameter so that is contacts the die wall within the range 28. If a thicker rod contacts the die wall at a point upstream of the range 28 (this is the case of the lefthand rod 16 in FIG. 8), the zone containing the pressurized lubricant is reduced and, as shown in FIG. 8, aluminum is swollen toward the side wall of the first frustoconical opening 12 to prevent the lubricant to penetrate into the succeeding second frustoconical opening 13, causing die galling. If a thinner rod contacts the die wall at a point downstream of the range 28 (this is the case of the righthand rod 16 in FIG. 8), there is left a large gap between the rod 16 and the side wall of the die opening, deteriorating the effect of the highly pressurized liquid lubricant as well as requiring a larger drawing force.

In the embodiment shown in FIG. 7*a*, an escape port 29 is provided at the junction between the die approach 10 and guide bushing 26 for discharging gradually accumulating metal debris, for example, aluminum powder left behind during drawing. This port 29 is provided for the purpose of preventing galling caused by the adhesion of aluminum powder to the opening walls of the guide bushing 26 and die 11. It also serves to prevent scratch on the wire surface and wire breaking due to jammed aluminum powder. A further advantage is to increase the life of the die. At the initial stage of drawing, the air in the die 11 and guide bushing 26 is vented through the port 29. Numeral 30 designates a die holder.

Figure 9:
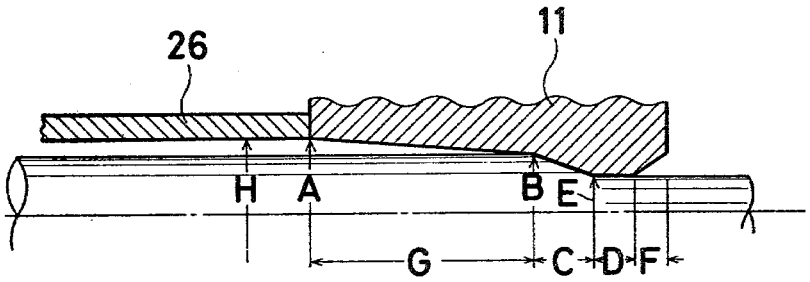
FIG. 9 is a cross section of the die apparatus of this invention illustrating the size of the respective components.

The particularly preferred size of each component of the die according to this invention is shown below. Using the drawing die assembly shown in FIG. 7*a*, an aluminum clad steel wire was drawn. The components of the die used have sizes represented by A to H as shown in FIG. 9.

A: diameter of the first frustoconical opening 12 at the inlet

B: diameter at the junction between the first and second frustoconical openings 12 and 13

C: axial length of the second frustoconical opening 13

D: axial length of the bearing 14

E: diameter of the bearing 14

F: axial length of the back relief 15

G: axial length of the first frustoconical opening 12

H: inner diameter of the guide bushing 26

The inclinations angles $\theta_1$ and $\theta_2$ of the die 11 used are as defined above. The wire was drawn at a drawing speed of 50–500 m/min. using polybutene oil as a lubricant. It was also possible to draw the wire at slower speeds, for example, at 10 m/min. Thinner the rod, higher the drawing speed is. The gap $g_2$ between the rod 16 and the guide bushing 26 as indicated by (H/B×100) in Table 3 may be as small as possible insofar as it allows the lubricant to flow into the die. With larger gaps, the lubricant tends to flow back, which is undesirable.

TABLE 3

| Preferred size of Die Components (mm) | | | | | | | | | |
|---|---|---|---|---|---|---|---|---|---|
| E | B | Reduction of area, % | D | G | C | F | A | H | H/B × 100 % |
| 2.0 | 2.17 | 5 | 1.7 | 20.61 | 0.69 | 2.0 | 2.88 | 2.5 | 115 |
| | 2.23 | 10 | 1.7 | 20.36 | 0.94 | 2.0 | 2.94 | 2.5 | 112 |
| 3.0 | 3.25 | 5 | 2.6 | 19.38 | 1.02 | 2.0 | 3.93 | 3.6 | 110 |
| | 3.35 | 10 | 2.6 | 18.97 | 1.43 | 2.0 | 4.01 | 3.6 | 107 |
| 4.0 | 4.33 | 5 | 3.4 | 18.26 | 1.34 | 2.0 | 4.97 | 4.8 | 111 |
| | 4.47 | 10 | 3.4 | 17.69 | 1.91 | 2.0 | 5.09 | 4.8 | 107 |
| 5.0 | 5.42 | 5 | 4.3 | 16.99 | 1.71 | 2.0 | 6.01 | 5.9 | 109 |
| | 5.59 | 10 | 4.3 | 16.30 | 2.40 | 2.0 | 6.16 | 5.9 | 106 |
| 6.0 | 6.51 | 5 | 5.1 | 15.82 | 2.08 | 2.0 | 7.06 | 7.0 | 108 |
| | 6.71 | 10 | 5.1 | 15.01 | 2.89 | 2.0 | 7.23 | 7.0 | 104 |
| 7.0 | 7.59 | 5 | 6.0 | 14.60 | 2.40 | 2.0 | 8.10 | 8.1 | 107 |
| | 7.83 | 10 | 6.0 | 13.62 | 3.38 | 2.0 | 8.31 | 8.1 | 103 |

As understood from the foregoing, a composite metal wire having a softer metal cladding around a harder metal core can effectively and advantageously be drawn by means of a very compact die apparatus according to this invention. Further, drawing can be continued for a long period of time and in a stable manner while nonuniform drawing and problems caused by metal debris left behind during drawing are eliminated. In addition, the life of the die according to this invention is long enough.

Since the compact die apparatus according to this invention may be handled in the same manner as in the case of usual dies for use in single wire drawing, the drawing process and apparatus of this invention are commercially advantageous.

What is claimed is:

1. A process for the fluid lubrication drawing of a rod in the form of a composite metal wire consisting of a harder metal core and a softer metal cladding surrounding the core comprising the steps of:

preparing a die having an approach which includes a first frustoconical opening having an included angle between 0° and 5° (exclusive of 0°) and a succeeding second frustoconical opening having an included angle between 6° and 20°, introducing the rod into said die together with a lubricant, and drawing the rod under fluid lubrication while pressurizing the lubricant in said first frustoconical opening of the die approach.

2. A drawing process according to claim 1, wherein said preparing step further comprises preparing a die having a first frustoconical opening of an axial length of at least 10 mm.

3. A drawing process according to claim 1, wherein said preparing step further comprises preparing a die in which the maximum diameter of said first frustoconical opening of the die approach and the diameter of the rod is 0.1–0.5 mm.

4. A drawing process according to claim 1, wherein said preparing step further comprises preparing a die in which said first opening is preceded by a guide section having a larger angle than that of said first opening for facilitating supply of the lubricant.

5. A drawing process according to claim 1, wherein the drawing step further comprises drawing a rod having a diameter which is equal to the diameter at the junction between said first and second frustoconical openings with a tolerance of plus or minus 5%.

6. A drawing process according to claim 1 wherein the rod is drawn at a drawing speed of 10–500 m/min.

7. A drawing process according to claim 1, further including the steps of positioning ahead of said die a guide bushing having an opening full of the lubricant, and introducing the rod into said die through said guide bushing.

8. A drawing process according to claim 7, wherein the positioning step further comprises positioning a guide bushing having an opening substantially equal in diameter to the opening of said die approach at the end thereof adjoining said guide bushing.

9. A drawing process according to claim 7, wherein the positioning step further comprises positioning a guide bushing having an opening of a diameter which is 0.2–1.0 mm larger than the diameter of the rod.

10. A drawing process according to claim 7, wherein said positioning step further comprises positioning a guide bushing having an axial length of 30–100 mm.

11. An apparatus for the fluid lubrication drawing of a rod in the form of a composite metal wire comprising a die having an approach which includes a first frustoconical opening having an included angle between 0° and 5° (exclusive of 0°) and a succeeding second frustoconical opening having an included angle between 6° and 20°.

12. A drawing apparatus according to claim 11 wherein said die approach is preceded by a guide section having a wide opening for facilitating supply of the lubricant.

13. A drawing apparatus according to claim 11, wherein said first frustoconical opening of the die approach has an axial length of at least 10 mm.

14. A drawing apparatus according to claim 11 which further comprises a guide bushing disposed in close engagement with said die approach and having an opening communicating with the opening of said die approach.

15. A drawing apparatus according to claim 14 wherein the opening of said guide bushing is substantially equal in diameter to the opening of said die approach at the end thereof adjoining said guide bushing.

16. A drawing apparatus according to claim 14 wherein the opening of said guide bushing has a diameter which is 0.2–1.0 mm larger than the diameter of the rod.

17. A drawing apparatus according to claim 14 wherein said guide bushing has an axial length of 30–100 mm.

18. A drawing apparatus according to claim 14 wherein an escape port is provided at the junction between said guide bushing and die approach for discharging metal debris left behind during drawing of the rod.

* * * * *